US007621753B1

(12) United States Patent
Pai

(10) Patent No.: US 7,621,753 B1
(45) Date of Patent: Nov. 24, 2009

(54) MAGNETIC POWER SOCKET AND PLUG AND COMBINATION THEREOF

(75) Inventor: Jason Pai, Shenkeng Township, Taipei County (TW)

(73) Assignee: Taiwan Line Tek Electronic Co., Ltd., Taipei County (TW)

( * ) Notice: Subject to any disclaimer, the term of this patent is extended or adjusted under 35 U.S.C. 154(b) by 0 days.

(21) Appl. No.: 12/340,874

(22) Filed: Dec. 22, 2008

(30) Foreign Application Priority Data

Nov. 5, 2008 (TW) ..... 97219763 U

(51) Int. Cl.
*H01R 9/05* (2006.01)

(52) U.S. Cl. ..... 439/63; 439/581; 439/39

(58) Field of Classification Search ..... 439/63, 439/581, 39, 180
See application file for complete search history.

(56) References Cited

U.S. PATENT DOCUMENTS 3,808,577 A * 4/1974 Mathauser ..... 439/39
6,409,519 B1 * 6/2002 Bacon ..... 439/63
6,808,405 B1 * 10/2004 Uratani et al. ..... 439/188
2002/0123250 A1 * 9/2002 Wang ..... 439/63
2005/0070158 A1 * 3/2005 Tateno ..... 439/581
2006/0134978 A1 * 6/2006 Rosen et al. ..... 439/581

* cited by examiner

*Primary Examiner*—Gary F. Paumen
(74) *Attorney, Agent, or Firm*—Guice Patents PLLC

(57) ABSTRACT

The present invention relates to a magnetic power socket and plug and combination thereof, comprises a power socket having a magnetic member; and a plug, the plug does not have magnetism but is able to be connected to the power socket via a magnetic force provided by the magnetic member. When the power plug is subject to an external lateral force, the power plug is able to be easily released from the power socket, so an electronic device coupled with the plug is prevented from falling or being damaged.

15 Claims, 7 Drawing Sheets

MAGNETIC POWER SOCKET AND PLUG AND COMBINATION THEREOF

BACKGROUND OF THE INVENTION

1. Field of the Invention

The present invention relates to a magnetic power socket and plug and combination thereof, more particularly to a magnetic power socket-plug combination, when the power plug is subject to an external lateral force, the power plug is able to be easily released from the power socket so an electronic device connected to the power plug is prevented from falling and being damaged.

2. Description of Related Art

A portable electronic device, e.g. a notebook computer, often obtains the required DC power via a power adapter. A socket-plug combination is provided between the power adapter and the notebook computer so as to stabilize the electrical connection between the power adapter and the notebook computer. In order to let the socket-plug combination achieve the described stable electrical connection, the power socket often has a relatively deep (or long) accommodating space, so the power plug is able to be stably plugged in.

When a user accidentally kicks or pulls the power adapter and the applied force is not large enough to separate the power socket and the power plug, the notebook computer connected to the socket-plug combination is likely to be pulled and fall from a high place where the notebook computer is placed, e.g. a desk or a worktable, therefore the notebook computer is damaged.

For improving and overcoming the described disadvantage, the present invention provides a magnetic power socket.

SUMMARY OF THE INVENTION

One object of the present invention is to provide a magnetic power socket having a magnetic member which is served to let a power plug of an electronic device be plugged in, when the power plug is subject to a lateral pulling force, the power plug is able to be easily released from the power socket, so the electronic device is prevented from falling due to the applied pulling force.

Another object of the present invention is to provide a magnetic power socket, an positive-pole contact probe of the magnetic power socket is able to be adjusted for lowering conduction resistance.

One another object of the present invention is to provide a magnetic power socket, an insulation cover of the power magnetic power socket is able to be replaced with respect to different machine modes so a fastening means thereof is correspondingly adjustable.

One another object of the present invention is to provide a magnetic power plug, the provided magnetic power plug is able to be plugged to a magnetic power plug via a magnetic force.

For achieving the objects mentioned above, the present invention discloses a magnetic power socket, comprises: a positive-pole plastic core having a hollow main body, a hollow chamber is extended from one end of the hollow main body; a positive-pole contact probe provided inside the hollow main body and the hollow chamber, one end of the positive-pole contact probe is exposed outside of the hollow main body, the other end thereof is exposed outside of the hollow chamber; a grounding copper ring provided on the positive-pole contact probe and the positive-pole plastic core for grounding; a magnetic member, a front end thereof has a first hole for accommodating the grounding copper ring; and an insulation cover serving to accommodate the magnetic member, a front end of the insulation cover is hollow and a fastening unit is provide below the insulation cover, the fastening unit is able to be mounted to the insulation cover, at least one fastening sheet is provided on the fastening unit for providing a fastening function.

For achieving the objects mentioned above, the present invention discloses a power plug, that is able to be plugged in a magnetic power socket via a magnetic force, comprises: a main body having a hollow chamber; a positive-pole contact section accommodated and fastened in the hollow chamber; a grounding copper ring provided outside of the positive-pole contact section and fastened in the hollow chamber, one end of the grounding copper ring is exposed outside of the hollow chamber for grounding; and a cable connecting section provided at one end of the main body, the cable connecting section has a round hole for receiving a positive cable and a negative cable, and the positive cable is in contact with the positive-pole contact section, the negative cable is in contact with the grounding copper ring.

For achieving the objects mentioned above, the present invention discloses a magnetic power socket and a socket-plug combination, comprises: a power socket having a magnetic member, and a plug, the plug does not has magnetism but is able to be connected to the power socket via a magnetic force provided by the magnetic member.

DETAILED DESCRIPTION OF THE PREFERRED EMBODIMENT

Figure 1:
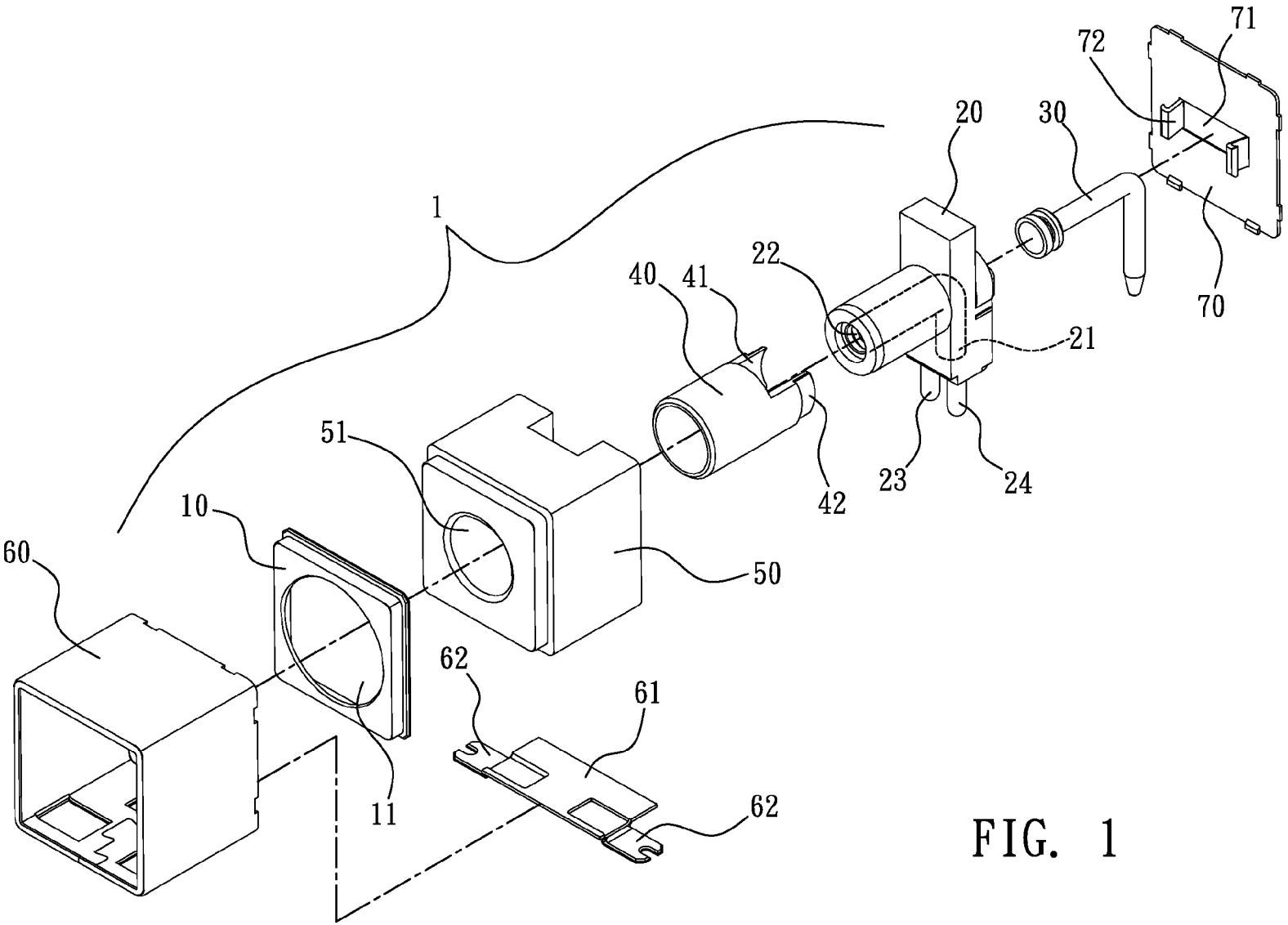
FIG. 1 is a schematic exploded view of a magnetic power socket of a preferred embodiment of the present invention.
Figure 2A:
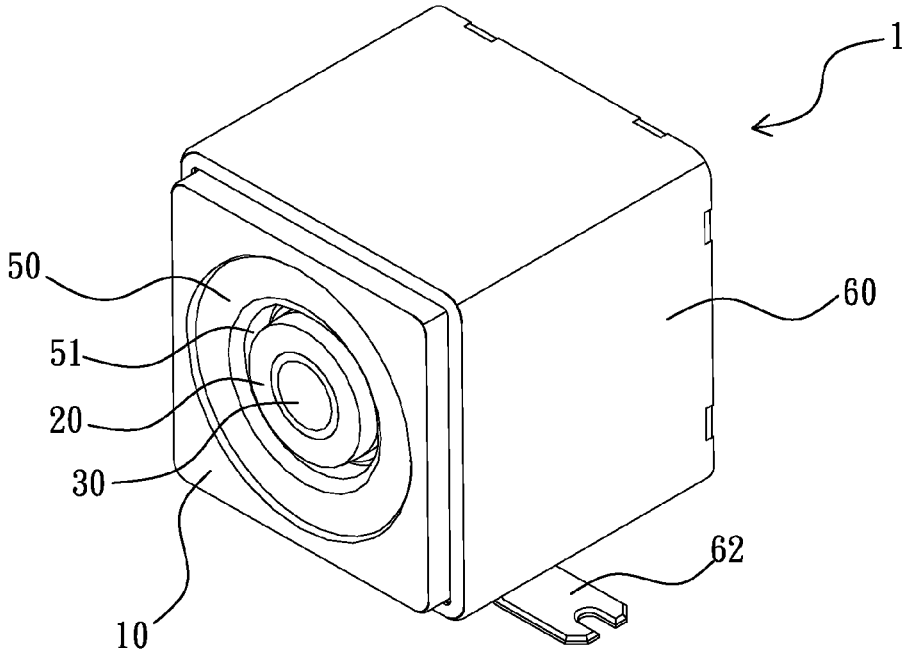
FIG. 2*a* is a schematic front view of the power socket of a preferred embodiment of the present invention after being assembled.
Figure 2B:
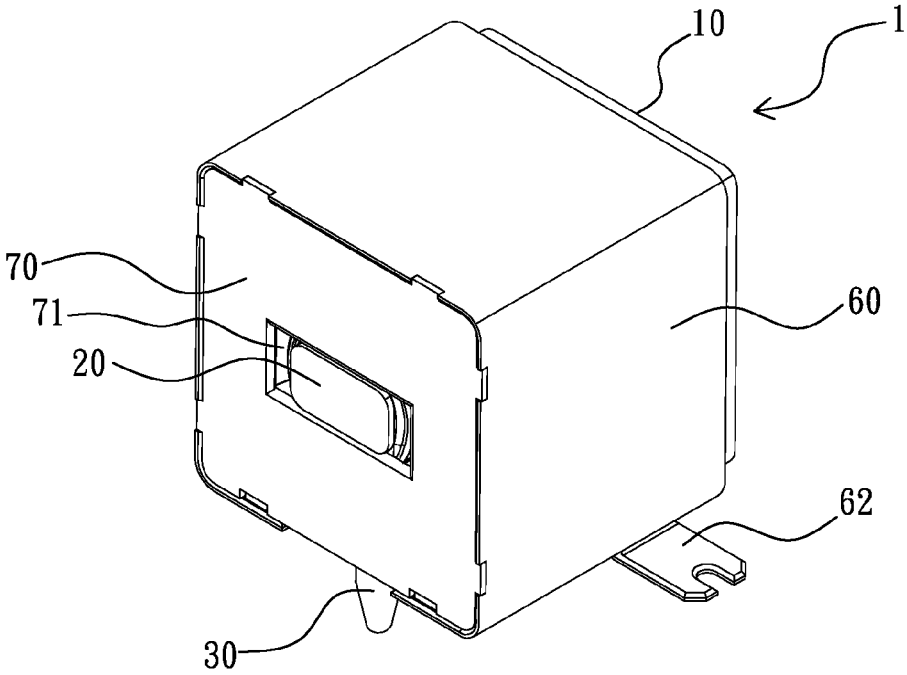
FIG. 2*b* is a schematic rear view of the power socket of a preferred embodiment of the present invention after being assembled.
Figure 2C:
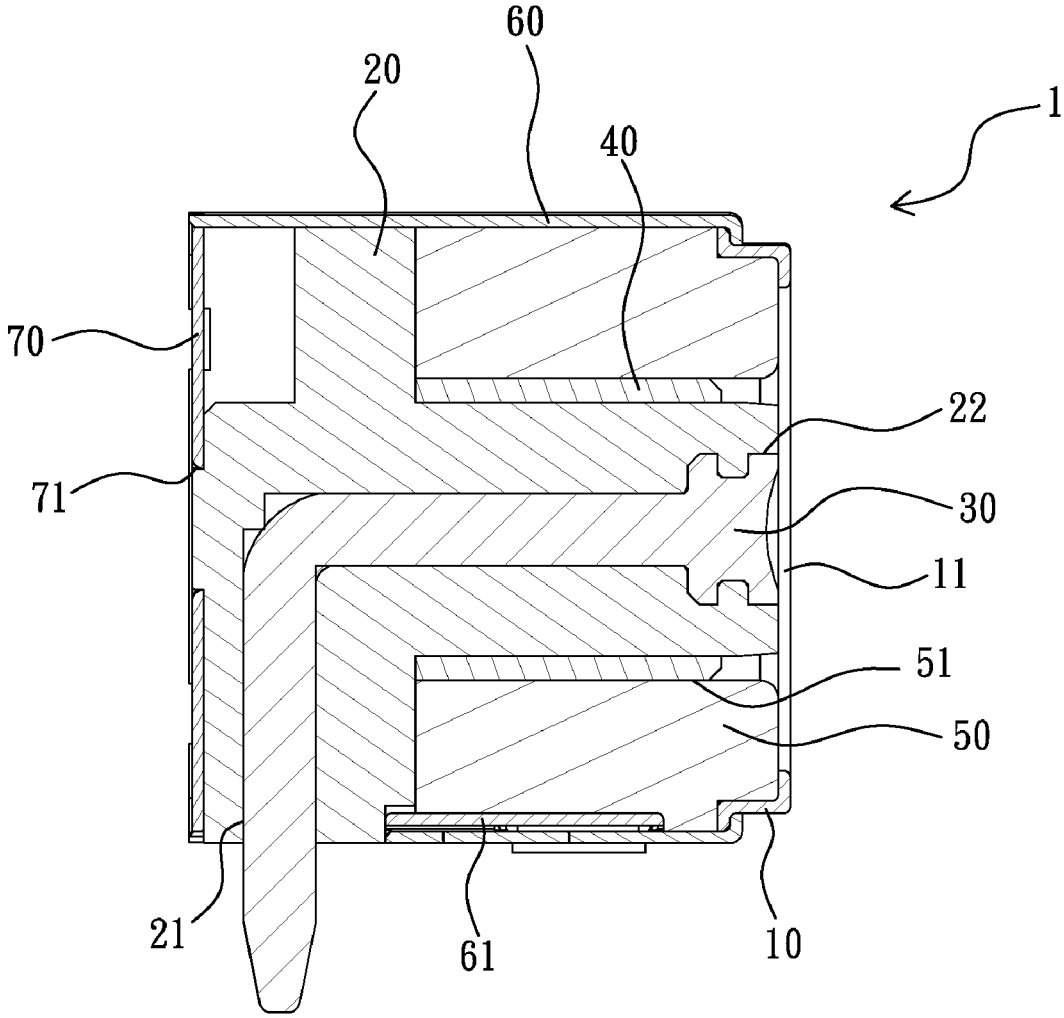
FIG. 2*c* is a schematic cross-sectional view of the power socket of a preferred embodiment of the present invention after being assembled.

Referring to FIG. 1 to FIG. 2*c*, wherein FIG. 1 is a schematic exploded view of a magnetic power socket of a preferred embodiment of the present invention; FIG. 2*a* is a schematic front view of the power socket of a preferred embodiment of the present invention after being assembled; FIG. 2*b* is a schematic rear view of the power socket of a preferred embodiment of the present invention after being assembled; FIG. 2*c* is a schematic cross-sectional view of the power socket of a preferred embodiment of the present invention after being assembled.

As shown in figures, the magnetic power socket 1 provided by the present invention, which is able to be used in a portable electronic device, e.g. but not limited to a notebook computer, comprises: a positive-pole plastic core 20; a positive-pole contact probe 30, a grounding copper ring 40, a magnetic member 50 and an insulation cover 60.

The positive-pole plastic core 20 has a hollow main body 21, e.g. but not limited to a tube shaped main body, a hollow chamber 22, e.g. but not limited to a tube shaped chamber, is extended from one end of the hollow main body 21, a front end of the hollow chamber 22 is served to let one end of the positive-pole contact probe 30 be exposed, the hollow main body 21 is served to let the other end of the positive-pole contact probe 30 be exposed. Bottom lateral ends of the positive-pole plastic core 20 are respectively provided with a fastening column, 23, 24 for being fastened on a substrate (not shown).

The positive-pole contact probe 30 is accommodated in the hollow main body 21 and the hollow chamber 22, and is bended to an angle closed to 90 degree, the shape therefore is for example but not limited to a tube shape so as to be easily accommodated in the hollow main body 21 and the hollow chamber 22, one end of the positive-pole contact probe 30 is exposed outside of the hollow main body 21, the other end thereof is exposed outside of the hollow chamber 22, a front end of the positive-pole contact probe 30 is in a, e.g. but limited to, a round-plate shape so as to be more easily in contact with conductive members of a plug 2 (referring to FIG. 3*a*), the direction of the positive-pole contact probe 30 is able to be adjusted for lowering conduction resistance.

The grounding copper ring 40 is provided on the positive-pole plastic core 20 and the positive-pole contact probe 30 for grounding; wherein bottom lateral ends of the grounding copper ring 40 are respectively provided with a grounding sheet 41, 42, the grounding sheets 41, 42 are served for grounding.

The magnetic member 50 can be, but not limited to, a permanent magnet, a front end thereof has a first hole 51 for accommodating the grounding copper ring 40.

The insulation cover 60 can be served to accommodate the positive-pole plastic core 20, the positive-pole contact probe 30, the grounding copper ring 40 and the magnetic member 50, two lateral ends of the insulation cover 60 are hollow and a fastening unit 61 is provided below the insulation cover 60, the fastening unit 61 can be mounted with the insulation cover 60 and at least one fastening sheet 62 is provided on the fastening unit 61 for being fastened on a substrate (not shown); in this embodiment two fastening sheets 62 are adopted for illustration but not served as a limit. The fastening sheets 62 can be replaced with respect to difference machine modes, e.g. a vertical type (not shown) or a horizontal type, so the fastening means can be adjusted, in this embodiment the horizontal type is adopted for illustration but not as a limit.

The insulation cover 60 further includes: a front cover member 10 and a rear cover member 70, when the front cover member 10, the rear cover member 70 and the insulation cover 60 are combined together, a good electrical shielding effect is provided. The front cover member 10 has a second hole 11 with a diameter slightly larger than the diameter of the first hole 51 and is connected to the front end of the magnetic member 50; the rear cover member 70 is provided at the rear end of the insulation cover 60 and has a breach 71, a connecting sheet 72 is respectively and inwardly extended from two ends of the breach 71, the two connecting sheets 72 are in contact with the grounding sheets 41, 42 so a grounding effect is achieved via the insulation cover 60.

As shown in FIG. 2*a* to FIG. 2*c*, when being assembled, the positive-pole plastic core 20 is firstly provided in the hollow main body 21 and the hollow chamber 22; the hollow main body 21 of the positive-pole plastic core 20 is fastened in the breach 71 of the rear cover member 70; then the grounding copper ring 40 is provided in the hollow chamber 22; the magnetic member 50 is provided on the grounding copper ring 40 and the grounding copper ring 40 is exposed outside of the first hole 51; then the insulation cover 60 is provided on the magnetic member 50; the front cover member 10 is provided at the front end of the magnetic member 50, the rear cover member 70 is provided at the rear end of the insulation cover 60, the magnetic power socket 1 provided by the present invention is therefore obtained.

Figure 3A:
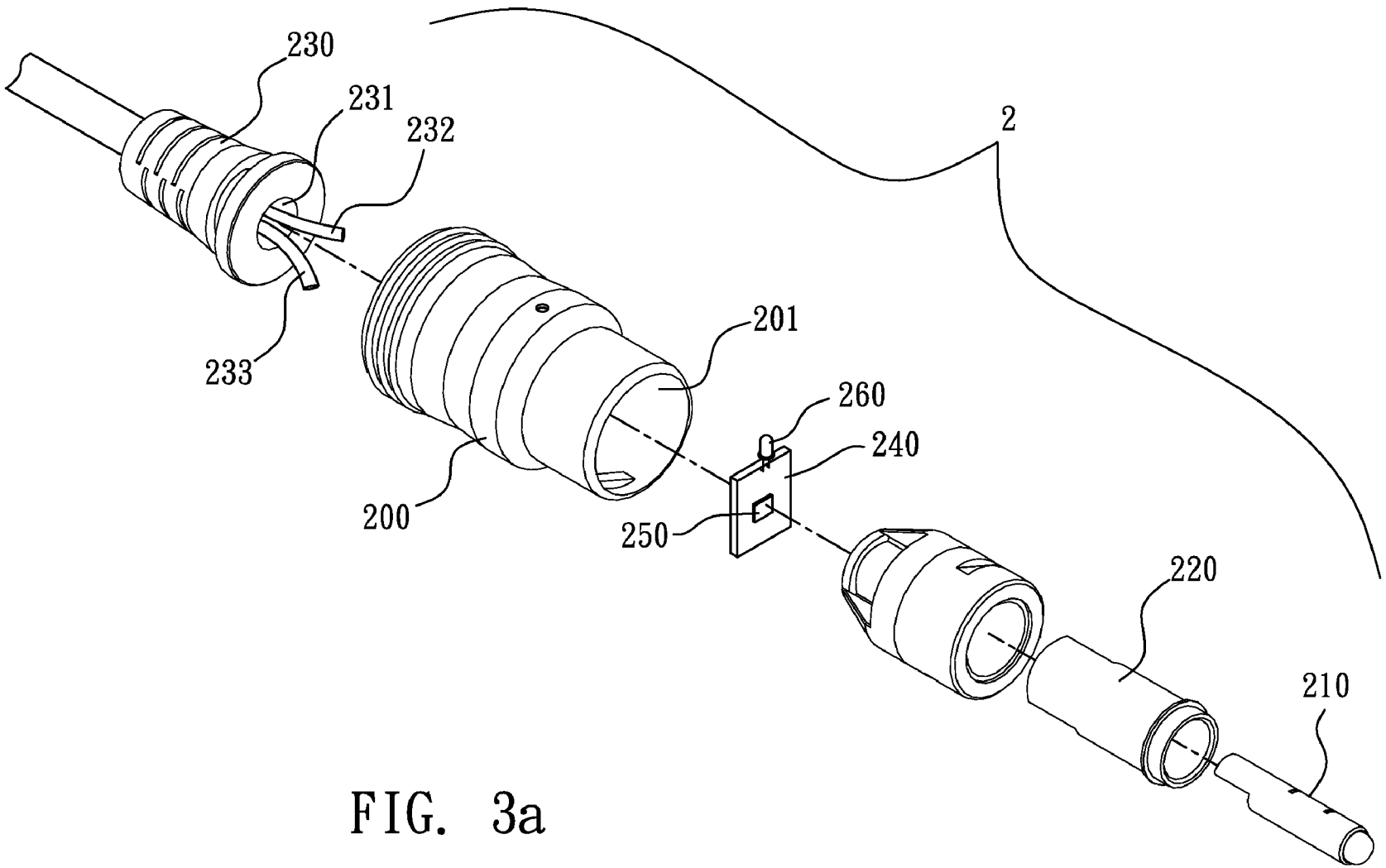
FIG. 3*a* is a schematic exploded view of a power plug of another embodiment of the present invention.
Figure 3B:
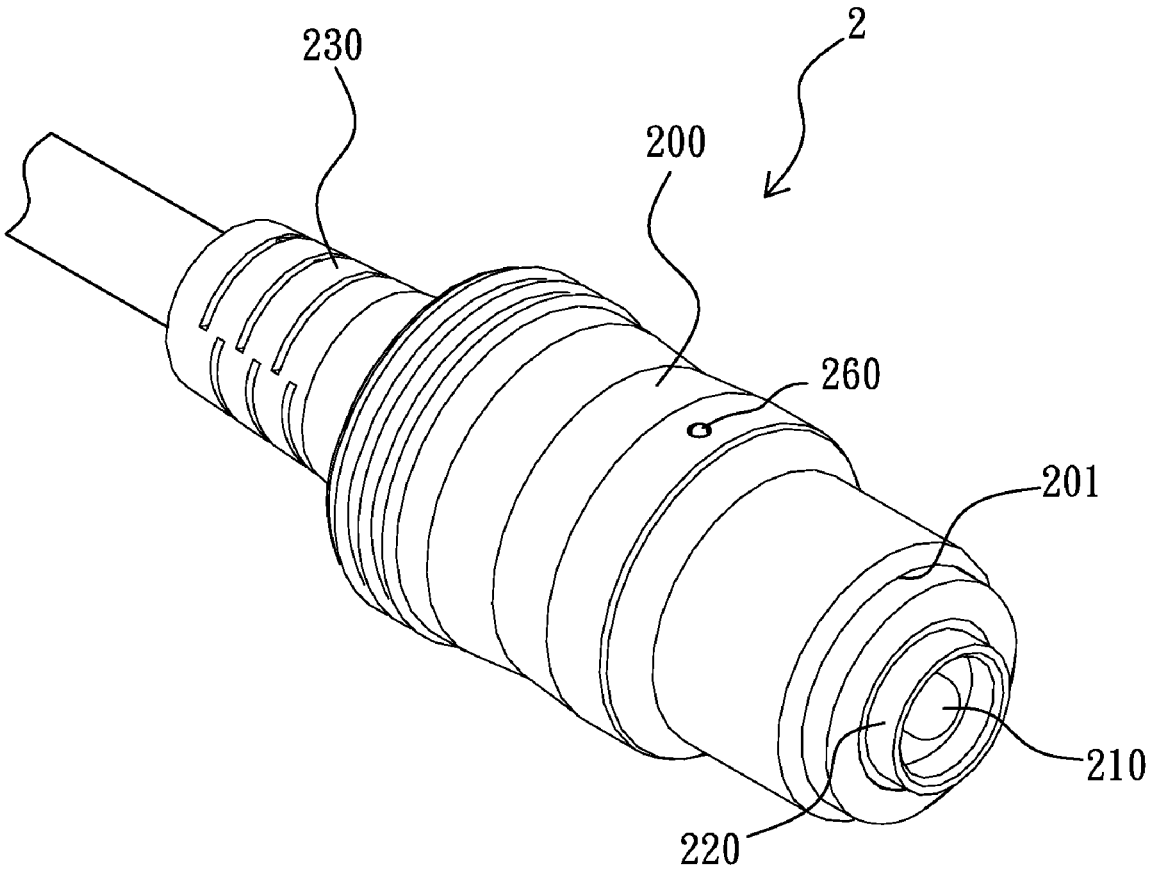
FIG. 3*b* is a schematic view illustrating the assembly of the power plug of the another embodiment of the present invention.

Referring to FIG. 3*a* and FIG. 3*b*, wherein FIG. 3*a* is a schematic exploded view of a power plug of another embodiment of the present invention; FIG. 3*b* is a schematic view illustrating the assembly of the power plug of the another embodiment of the present invention.

As shown in figures, the power plug 2 provided by the present invention is able to be plugged in the magnetic power socket 1 via a magnetic force, and the power plug 2 comprises: a main body 200, a positive-pole contact section 210, a grounding copper ring 220 and a cable connecting section 230.

The main body 200 is made of insulation material, e.g. but not limited to plastic material, and has a hollow chamber 201.

The positive-pole contact section 210 is accommodated and fastened in the hollow chamber 201 and served to be in contact with the positive-pole contact probe 30 mentioned above.

The grounding copper ring 220 is provided outside of the positive-pole contact section 210 and is fastened in the hollow chamber 201, one end of the grounding copper ring 220 is exposed outside of the hollow chamber 201 so as to be in contact with the grounding copper ring 40 mentioned above, a grounding effect is therefore obtained.

The cable connecting section 230 is provided at one end of the main body 200, e.g. but not limited to a rear end, and has a round hole 231 served to accommodate a positive cable 232 and a negative cable 233, and the positive cable 232 is in contact with the positive-pole contact section 210, the negative cable 233 is in contact with the grounding copper ring 220.

The power plug 2 provided by the present invention further includes a printed circuit board 240, the printed circuit board 240 is provided in the main body 200 and between the grounding copper ring 220 and the positive cable 232 and the negative cable 233; so the positive cable 232 and the negative cable 233 are provided on the printed circuit board 240.

The power plug 2 provided by the present invention further includes a surge absorber 250, the surge absorber 250 is provided on the printed circuit board 240 and coupled with the positive cable 232 and the negative cable 233, and served to absorb surge generated due to short-circuit, so an abnormal surge generated when the positive-pole contact section 210 and the positive-pole contact probe 30 are in contact and accidentally in contact with the grounding copper ring 40 is prevented, the connected portable electronic device is therefore protected.

The power plug 2 provided by the present invention further includes an indicating lamp 260, e.g. but not limited to a LED, the indicating lamp 260 is provided the printed circuit board 240 and coupled with the positive cable 232 and the negative cable 233 and is exposed outside of the main body 200 for power indication.

Figure 4A:
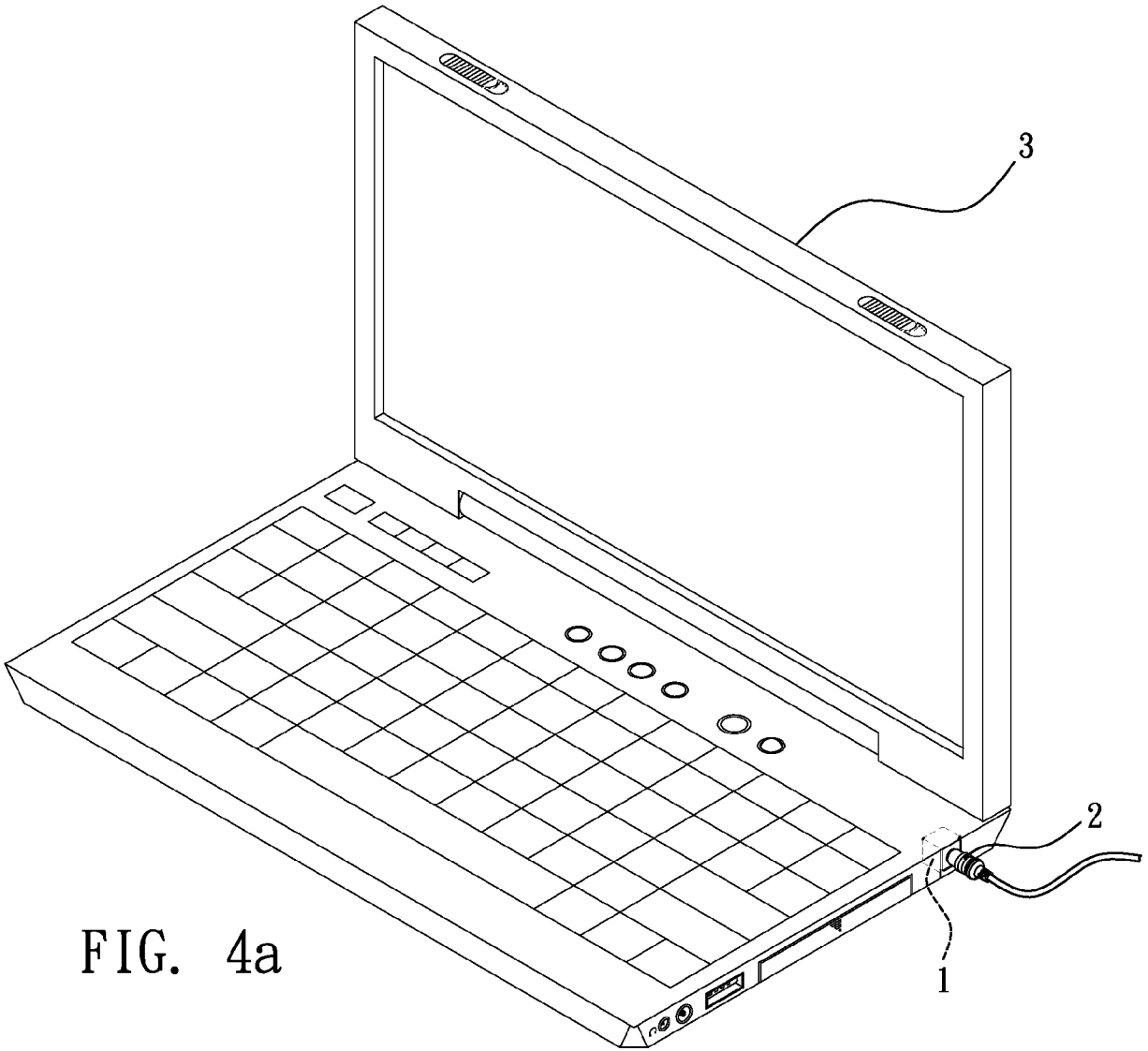
FIG. 4*a* is a schematic view illustrating the magnetic power socket being connected to a plug.
Figure 4B:
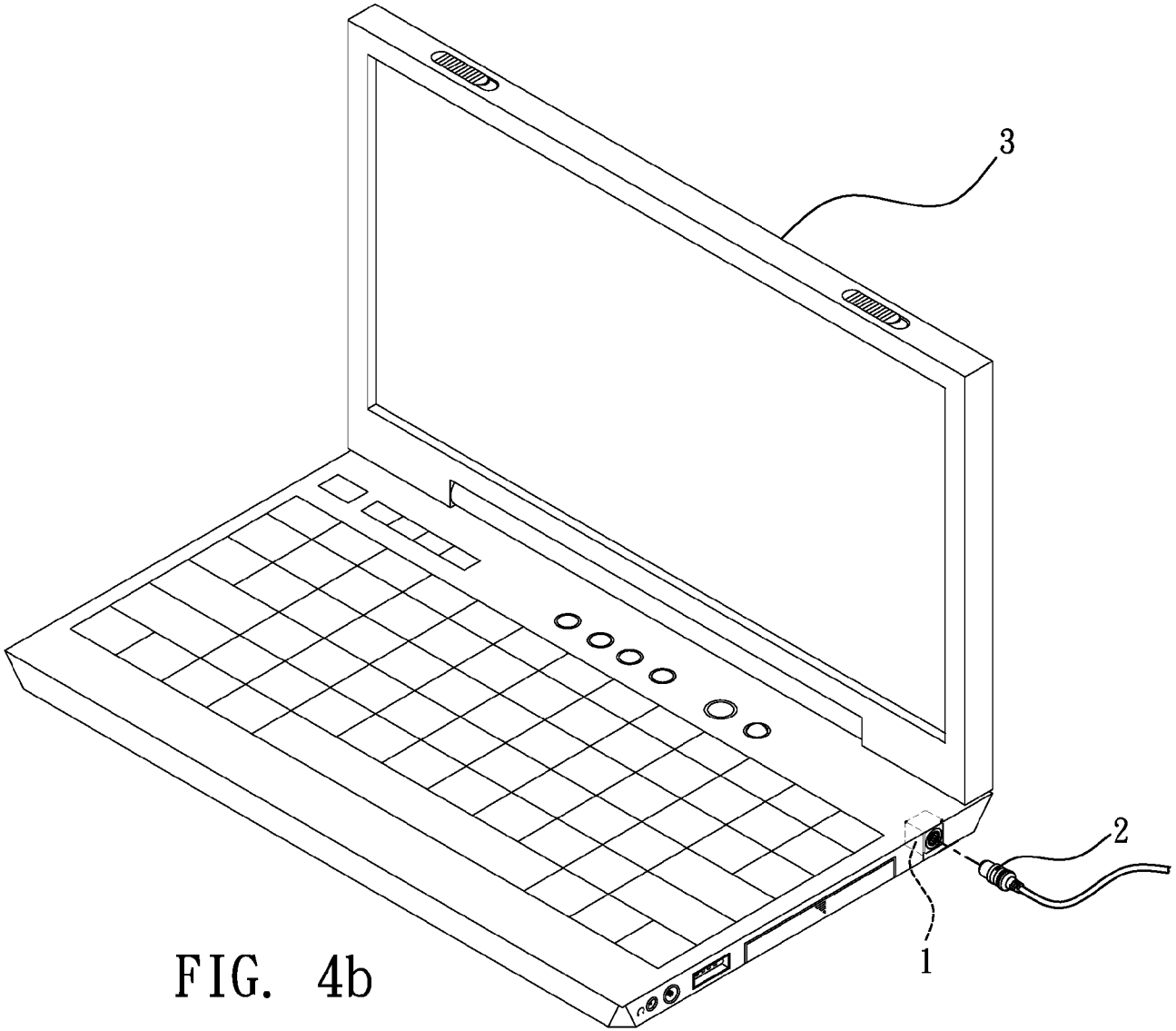
FIG. 4*b* is a schematic view illustrating the magnetic power socket being released from a plug.

Referring to FIG. 4*a*, FIG. 4*b* and FIG. 2*c* again, wherein FIG. 4*a* is a schematic view illustrating the magnetic power socket being connected to a plug; FIG. 4*b* is a schematic view illustrating the magnetic power socket being released from a plug.

As shown in FIG. 4*a*, when the magnetic power socket 1 provided by the present invention is used, the magnetic power socket 1 is fastened on a substrate (not shown) of a portable electronic device, the portable electronic device can be, but not limited to, a notebook computer, in this embodiment a notebook computer is adopted for illustration but not as a limit; when a power plug 2 of the portable electronic device is desired to be plugged in the magnetic power socket 1, via a magnetic force provided by the magnetic member 50, the positive-pole contact section 210 and the grounding copper ring 220 of the plug 2 are easily and respectively to be in contact with the positive-pole contact probe 30 and the grounding copper ring 40 of the socket 1, an electrical connection is therefore obtained.

Referring to FIG. 2*c*, the surface of the positive-pole contact probe 30 is in a slight concave status when compared with the surface of the first hole 51, as shown in FIG. 4*b*, when a user accidentally kicks or pulls the plug 2, the positive-pole contact section 210 of the plug 2 is easily to be released from the positive-pole contact probe 30 via a slight lateral force, so the portable electronic device is prevented from falling or being damaged.

The magnetic power socket provided by the present invention has a magnetic member so a power plug of an electronic device is able to plugged in via a magnetic force, when the power plug is subject to an external lateral force, the power plug is easily to be released from the power socket so the electronic device is prevented from falling and being damaged; the positive-pole contact probe is able to be adjusted for lowering conduction resistance; and the insulation cover is able to be replaced with respect to different machine modes therefore a means for fastening the insulation cover is adjustable.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A magnetic power socket, served to let a power plug be plugged in via a magnetic force, comprises:

a positive-pole plastic core having a hollow main body, a hollow chamber is extended from one end of the hollow main body;

a positive-pole contact probe provided inside the hollow main body and the hollow chamber, one end of the positive-pole contact probe is exposed outside of the hollow main body, the other end thereof is exposed outside of the hollow chamber;

a grounding copper ring provided on the positive-pole contact probe and the positive-pole plastic core for grounding;

a magnetic member, a front end thereof has a first hole for accommodating the grounding copper ring; and an insulation cover serving to accommodate the magnetic member, a front end of the insulation cover is hollow and a fastening unit is provide below the insulation cover, the fastening unit is able to be mounted to the insulation cover, at least one fastening sheet is provided on the fastening unit.

2. The magnetic power socket as claimed in claim 1, wherein the hollow chamber and the hollow main body are both in a tubular shape, and the positive-pole contact probe is in a tubular shape for being accommodated in the hollow chamber, and the front end thereof is in a round-plate shape.

3. The magnetic power socket as claimed in claim 1, wherein there are two fastening sheets provided, and the fastening sheets are vertical type or horizontal type, and the positive-pole plastic core is made of transparent plastic material, bottom lateral ends thereof is respectively provided with a fastening column for being fastened on a substrate.

4. The magnetic power socket as claimed in claim 1, the magnetic power socket further comprises:

a front cover member, the front cover member has a second hole with a diameter slightly larger than the diameter of the first hole and is connected to the front end of the magnetic member; and a rear cover member, the rear cover member is provided at the rear end of the insulation cover and has a breach, a connecting sheet is respectively and inwardly extended from two ends of the breach.

5. The magnetic power socket as claimed in claim 4, wherein two bottom lateral ends of the grounding copper ring respectively have a grounding sheet, the ground sheets are exposed out of the breach for being connected to the connecting sheets.

6. The magnetic power socket as claimed in claim 1, the magnetic power socket further includes an indicating device coupled with the positive-pole plastic core and the grounding copper ring, and light illuminated is able to be transferred to outside via the positive-pole plastic core.

7. A power plug, which is able to be plugged in a magnetic power socket, comprises:

a main body having a hollow chamber;

a positive-pole contact section accommodated and fastened in the hollow chamber; a grounding copper ring provided outside of the positive-pole contact section and fastened in the hollow chamber, one end of the grounding copper ring is exposed outside of the hollow chamber for grounding;

a cable connecting section provided at one end of the main body, the cable connecting section has a round hole for receiving a positive cable and a negative cable, and the positive cable is in contact with the positive-pole contact section, the negative cable is in contact with the grounding copper ring; and a printed circuit board, a surge absorber and an indicating lamp, wherein the printed circuit board is provided in the main body and between the grounding copper ring and the positive and the negative cables, so the positive and the negative cables are provided on the printed circuit board; the surge absorber is provided on the printed circuit board and coupled to the positive and the negative cables, and is served to absorb a surge generated due to the abnormal grounding of the positive-pole contact section; and the indicating lamp is provided on the printed circuit board and coupled with the positive and the negative cables and is exposed out of the main body for indication.

8. A magnetic power socket-plug combination, comprises:

a power socket having a magnetic member;

a plug, the plug does not have magnetism but is able to be connected to the power socket via a magnetic force provided by the magnetic member;

a positive-pole plastic core having a hollow main body, a hollow chamber is extended from one end of the hollow main body;

a positive-pole contact probe provided inside the hollow main body and the hollow chamber, one end of the positive-pole contact probe is exposed outside of the hollow main body, the other end thereof is exposed outside of the hollow chamber;

a grounding copper ring provided on the positive-pole contact probe and the positive-pole plastic core for grounding;

a magnetic member, a front end thereof has a first hole for accommodating the grounding copper ring; and an insulation cover serving to accommodate the magnetic member, a front end of the insulation cover is hollow and a fastening unit is provide below the insulation cover, the fastening unit is able to be mounted to the insulation cover, at least one fastening sheet is provided on the fastening unit.

9. The magnetic power socket-plug combination as claimed in claim 8, wherein the hollow chamber and the hollow main body are both in a tubular shape, and the positive-pole contact probe is in a tubular shape for being accommodated in the hollow chamber, and the front end thereof is in a round-plate shape.

10. The magnetic power socket-plug combination as claimed in claim 8, wherein there are two fastening sheets provided, and the fastening sheets are vertical type or horizontal type, and the positive-pole plastic core is made of transparent plastic material, bottom lateral ends thereof is respectively provided with a fastening column for being fastened on a substrate.

11. The magnetic power socket-plug combination as claimed in claim 8, the magnetic power socket-plug combination further includes:

a front cover member, the front cover member has a second hole with a diameter slightly larger than the diameter of the first hole and is connected to the front end of the magnetic member; and a rear cover member, the rear cover member is provided at the rear end of the insulation cover and has a breach, a connecting sheet is respectively and inwardly extended from two ends of the breach.

12. The magnetic power socket-plug combination as claimed in claim 11, wherein two bottom lateral ends of the grounding copper ring respectively have a grounding sheet, the ground sheets are exposed out of the breach for being connected to the connecting sheets.

13. The magnetic power socket-plug combination as claimed in claim 11, the magnetic power socket-plug combination further includes an indicating device coupled with the positive-pole plastic core and the grounding copper ring, and light illuminated is able to be transferred to outside via the positive-pole plastic core.

14. A magnetic power socket-plug combination, comprises:

a power socket having a magnetic member;

a plug, the plug does not have magnetism but is able to be connected to the power socket via a magnetic force provided by the magnetic member;

a main body having a hollow chamber;

a positive-pole contact section accommodated and fastened in the hollow chamber; a grounding copper ring provided outside of the positive-pole contact section and fastened in the hollow chamber, one end of the grounding copper ring is exposed outside of the hollow chamber for grounding; and a cable connecting section provided at one end of the main body, the cable connecting section has a round hole for receiving a positive cable and a negative cable, and the positive cable is in contact with the positive-pole contact section, the negative cable is in contact with the grounding copper ring.

15. The magnetic power socket-plug combination as claimed in claim 14, wherein the power plug further includes a printed circuit board, a surge absorber and an indicating lamp, wherein the printed circuit board is provided in the main body and between the grounding copper ring and the positive and the negative cables, so the positive and the negative cables are provided on the printed circuit board; the surge absorber is provided on the printed circuit board and coupled to the positive and the negative cables, and is served to absorb a surge generated due to the abnormal grounding of the positive-pole contact section; and the indicating lamp is provided on the printed circuit board and coupled to the positive and the negative cables and is exposed out of the main body for indication.

* * * * *